US008215081B2

(12) United States Patent
Cummings et al.

(10) Patent No.: US 8,215,081 B2
(45) Date of Patent: Jul. 10, 2012

(54) PANEL TILE AND TOP CAP RETENTION SYSTEM

(75) Inventors: Daniel R. Cummings, Appleton, WI (US); David D. Liegeois, Little Suamico, WI (US); Steven C. Gevaert, Green Bay, WI (US)

(73) Assignee: Krueger International, Inc., Green Bay, WI (US)

( * ) Notice: Subject to any disclaimer, the term of this patent is extended or adjusted under 35 U.S.C. 154(b) by 161 days.

(21) Appl. No.: 12/693,040

(22) Filed: Jan. 25, 2010

(65) Prior Publication Data

US 2010/0186326 A1 Jul. 29, 2010

Related U.S. Application Data

(60) Provisional application No. 61/148,087, filed on Jan. 29, 2009.

(51) Int. Cl.
*E04B 1/00* (2006.01)
*E04H 1/00* (2006.01)
*E04H 12/00* (2006.01)

(52) U.S. Cl. ..... 52/745.05; 52/239; 52/300

(58) Field of Classification Search ..... 52/239, 52/300, 238.1, 240, 241, 243, 243.1
See application file for complete search history.

(56) References Cited

U.S. PATENT DOCUMENTS

| | | | | |
|---|---|---|---|---|
| 2,081,368 | A | 5/1937 | Pretot | |
| 3,731,447 | A | 5/1973 | Dawdy et al. | |
| 3,753,325 | A | 8/1973 | Stanley et al. | |
| 4,250,676 | A | 2/1981 | Presby | |
| 4,330,974 | A | 5/1982 | Fleisch et al. | |
| 4,423,573 | A | 1/1984 | Omholt et al. | |
| 4,611,448 | A | 9/1986 | De Long | |
| 4,719,731 | A | 1/1988 | Ravotti et al. | |
| 4,891,922 | A * | 1/1990 | Hozer et al. | 52/239 |
| 4,949,519 | A * | 8/1990 | Jeffers | 52/239 |
| 5,642,593 | A * | 7/1997 | Shieh | 52/239 |
| 5,664,380 | A | 9/1997 | Hsueh | |
| 5,806,258 | A | 9/1998 | Miedema et al. | |
| 6,079,173 | A * | 6/2000 | Waalkes et al. | 52/239 |
| 6,279,278 | B1 | 8/2001 | Morris et al. | |
| 6,336,298 | B1 | 1/2002 | Chou | |
| 6,820,388 | B2 | 11/2004 | Newhouse et al. | |
| 8,046,962 | B2 * | 11/2011 | Glick et al. | 52/239 |
| 2002/0117270 | A1 * | 8/2002 | Steeves et al. | 160/135 |
| 2008/0104907 | A1 * | 5/2008 | Glick et al. | 52/239 |

* cited by examiner

*Primary Examiner* — Mark Wendell
(74) *Attorney, Agent, or Firm* — Andrus, Sceales, Starke & Sawall, LLP

(57) ABSTRACT

A system and method to attach and retain panel tiles and a top cap to a support frame of a modular wall panel system. The top cap attached to the support frame includes an elongated body having a one or more attachment clips removably attached to the elongated body at desired locations along the length of the elongated body. The attachment clips and elongated body are formed separately and assembled prior to attachment to the modular panel. The elongated body includes a pair of receiving cavities that receive spring arms formed on each of the attachment clips. The attachment clips are rotated into position such that the spring arms engage the elongated body and hold the attachment clips in position. Each panel includes a stiffener bracket having engagement tabs. The engagement tabs are received within notches formed in the vertical posts to secure the tiles to the support frame.

11 Claims, 5 Drawing Sheets

PANEL TILE AND TOP CAP RETENTION SYSTEM

CROSS-REFERENCE TO RELATED APPLICATION

The present application is based on and claims priority to U.S. Provisional Patent Application Ser. No. 61/148,087 filed Jan. 29, 2009.

BACKGROUND OF THE INVENTION

The present disclosure generally relates to a modular wall panel system. More specifically, the present disclosure relate to the construction of an individual panel that can be used as part of the modular wall panel system.

Panel-type wall systems are commonly used to divide space in an open-plan office environment. In a typical modular panel-type wall system, a number of wall panels are interconnected together in a configuration suitable for the intended use of the space. Each wall panel typically includes a structural frame to which a pair of tiles are mounted. The tiles may be broadly classified as either decorative tiles or functional files. Decorative tiles typically have an acoustic insulating material covered by an appropriate finishing material such as fabric, metal or wood and are designed to provide sound proofing and aesthetic appearance. Functional tiles generally have a frame that supports functional components, such as a tool rail, one or more hooks, an opening, a window, a shelf, a marker board, paper management components, etc.

When attaching tiles to the frame of the wall panel system, it is desirable to secure the tiles to the frame so that the tiles, which may be heavy, expensive, or both, are positively secured to the frame. Inadvertent placement of a tile on a frame without the proper secure connection may not provide adequate support and could allow a tile to fall, causing damage or injury to those in the vicinity of the tile.

Since modular panel-type wall systems must be shipped from a manufacturer to the location where the wall system is installed, it is desirable that the individual components needed to construct the panel-type wall system can be shipped in as little space as possible to reduce shipping costs. Therefore, it is desirable for individual components of the wall system to be shipped in a compact, space saving configuration and assembled on site after shipping.

SUMMARY OF THE INVENTION

The present disclosure relates to a modular wall panel system and specifically to the method of assembling a top cap prior to installation onto the support frame of a modular wall panel. The modular panel system includes a support frame that includes a pair of vertical posts and a header that extends between the vertical posts to stabilize the vertical posts. Each of the vertical posts is formed with at least one receiving notch. Preferably, each of the vertical posts includes a series of receiving notches spaced along the length of the vertical posts and formed in both sidewalls of the vertical posts. The modular panel system includes at least one tile that can be supported along the support frame. Preferably, the modular panel system includes both an interior tile and an exterior tile mounted to the support frame.

Each of the interior and exterior tiles includes a pair of tile stiffener brackets that are attached to an inner surface of the tile. The tile stiffener brackets each include at least one engagement tab that extends from the tile stiffener bracket. When the tile is mounted to the vertical posts of the support frame, the engagement tabs are received in the receiving notches formed in the vertical posts. The interaction between the engagement tabs and the receiving notches formed on the vertical posts centers the tile on the support frame and prevents the tile from becoming separated from the vertical posts.

The modular panel system further includes a top cap that is mounted to the header extending between the pair of vertical posts. The top cap is formed from an elongated body and includes at least one attachment clip. The attachment clip facilitates mounting of the top cap to the header.

The elongated body of the top cap extends along a longitudinal axis and includes an outer surface, an inner surface and a pair of spaced sidewalls. A pair of spaced receiving channels is formed on the elongated body and each extend along the entire length of the elongated body. Each of the receiving cavities is formed by the inner surface and one of the pair of sidewalls.

Each of the attachment clips includes a main body that extends along a longitudinal axis and has a pair of spring arms connected to the main body. When the attachment clip is attached to the elongated body, the spring arms are received in the receiving cavities to secure the attachment clip to the elongated body. Preferably, the width of the attachment clip between the pair of spring arms is greater than the width of the elongated body such that the spring arms deflect and exert a force on the sidewalls of the elongated body to hold the attachment clips in position along the elongated body.

Each attachment clip is secured to the elongated body by initially positioning the attachment clip on an inner surface of the elongated body. In this position, the longitudinal axis of the attachment clip is positioned at an angle relative to the longitudinal axis of the elongated body. Once in the desired position, the attachment clip is rotated such that the spring arms of the attachment clips enter into the receiving cavities formed along the elongated body. As the attachment clip continues to rotate, the spring arms deflect until the attachment clip has been rotated into the final position. In the final position, the longitudinal axis of the attachment clip is perpendicular to the longitudinal axis of the elongated body.

Once each of the attachment clips has been attached to the elongated body, the assembled top cap can be attached to the header of the support frame for the modular wall panel.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION OF THE INVENTION

Figure 1:
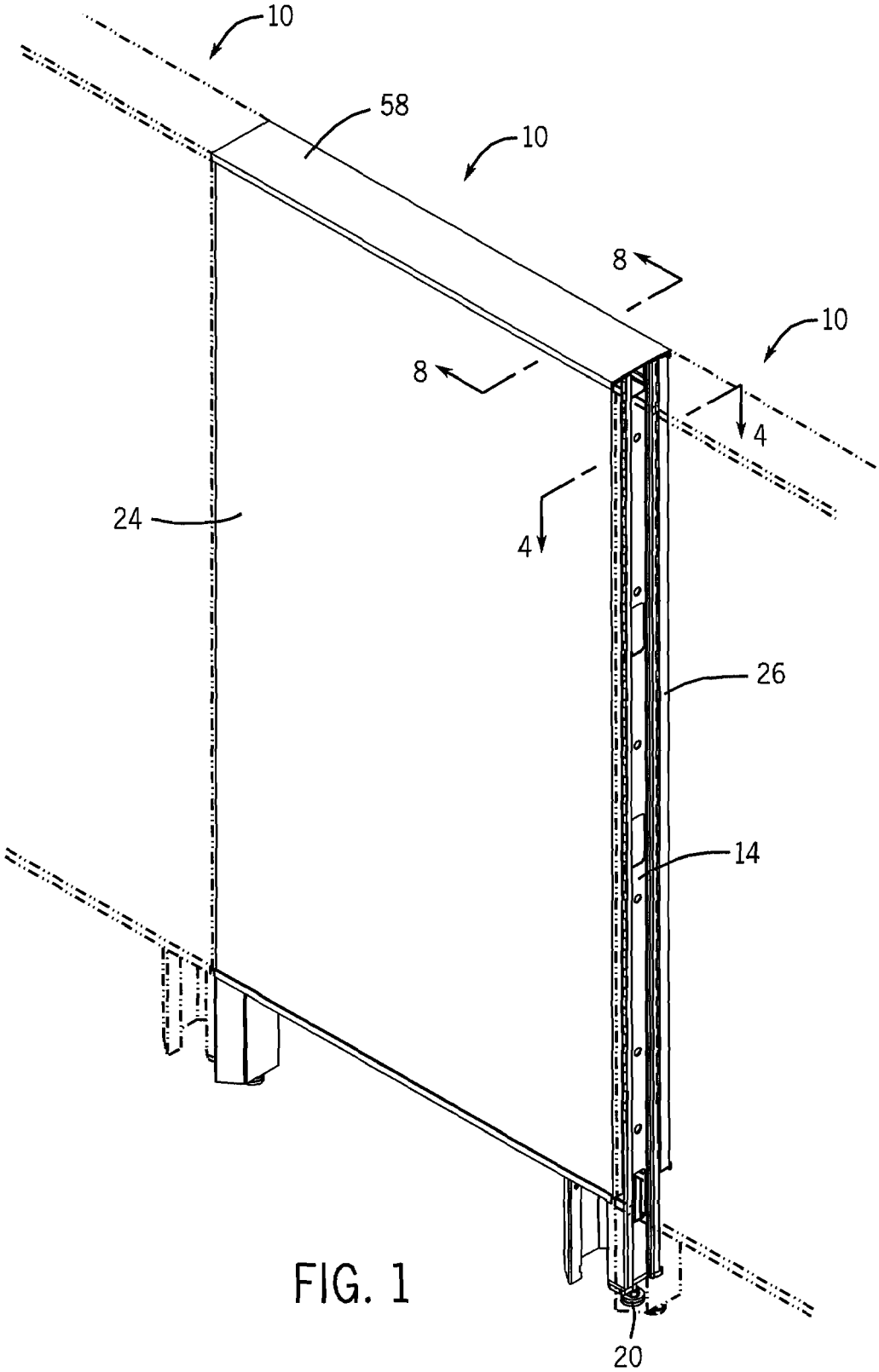
FIG. 1 is a perspective view of an individual panel of a modular panel system including a top cap and tile mounting system of the present disclosure.

FIG. 1 generally illustrates a modular panel 10 that can be used as part of a modular panel-type wall system to divide an open-plan office environment. In the embodiment shown in FIG. 1, the modular panel 10 is shown connected to a pair of adjacent modular panels 10 shown in phantom. The modular panel 10 is part of a wall system that can be configured in various different manners, as is well known.

Figure 2:
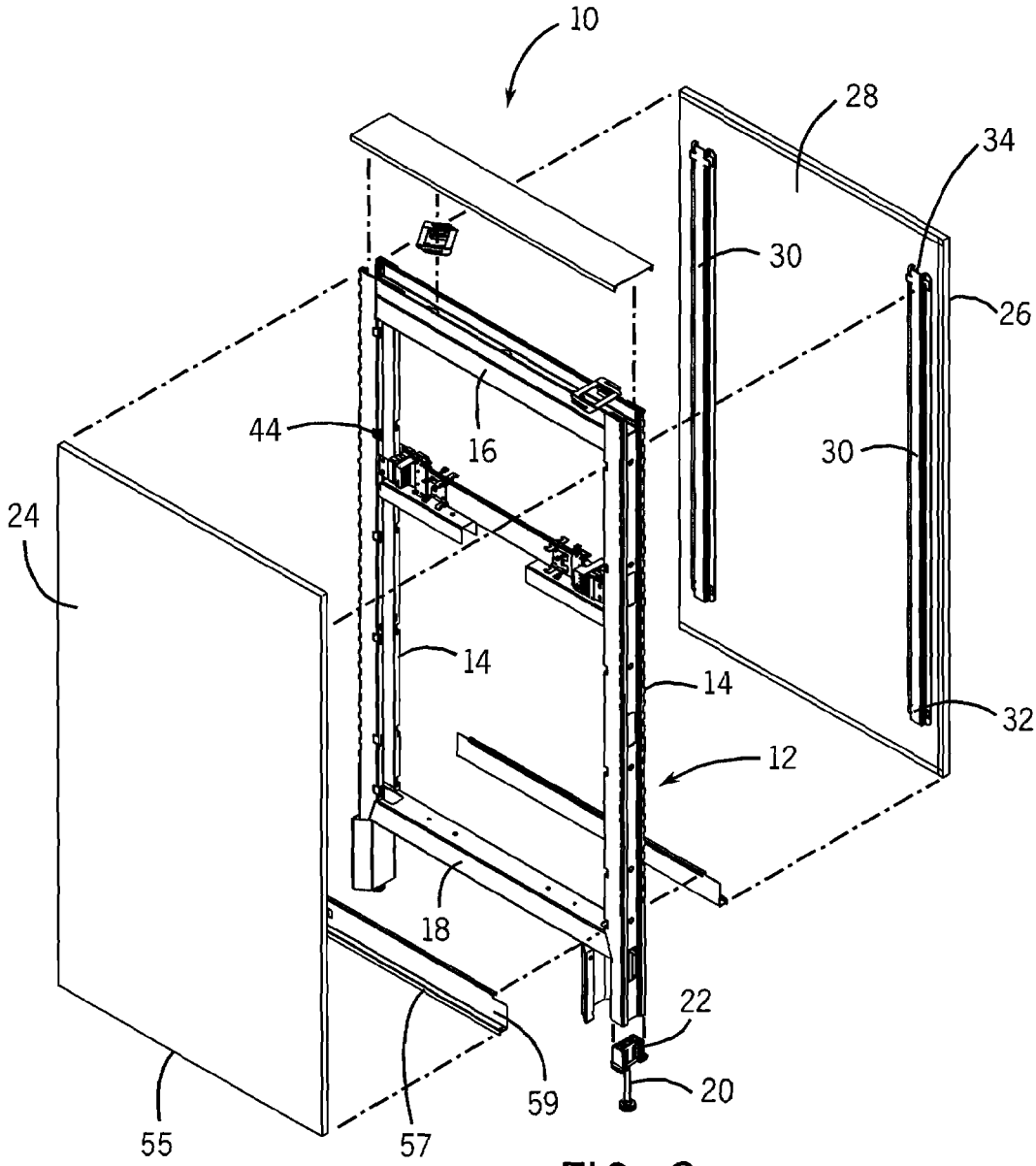
FIG. 2 is an exploded view of one of the modular panels.

The modular panel 10 of FIGS. 1 and 2 generally includes a support frame 12. The support frame 12 includes a pair of spaced vertical posts 14. The vertical posts 14 are interconnected by a pair of cross supports which include a header 16 and a sill 18. The header 16 and sill 18 provide structural stability for the pair of spaced vertical posts 14. Each of the vertical posts 14 includes an adjustable foot 20 received within end cap 22. The adjustable foot 20 allows orientation of the support frame to be adjusted to compensate for an uneven support surface. In the embodiment shown in FIG. 2, each of the vertical posts 14, as well as the header 16 and sill 18, are generally hollow members to reduce the overall weight of the modular panel 10 and allow for data or power cables to pass through the structural components of the modular panel 10.

In most embodiments, the support frame 12 receives both an interior tile 24 and an exterior tile 26 to complete the modular panel 10. In the embodiment illustrated in FIG. 2, the interior tile 24 and the exterior tile 26 have an identical configuration such that the interior and exterior tiles 24, 26 can be mounted to either side of the support frame 12. In the embodiment shown, each of the interior and exterior tiles 24, 26 are constructed using a wood fiberboard core (particle board) in which the fibers are bonded together with starch fillers. However, steel tiles can also be used in place of the particle board while operating within the scope of the present disclosure. The external surface of the core of each of the tiles 24, 26 receive a class A frame retardant prime coat and fabric is laminated directly on the exterior surface of the core using a hot melt adhesive that is typically applied as a spray. Although fabric is shown and described as being attached to the exterior surface of both of the interior and exterior tiles 24, 26, it should be understood that other types of decorative material could be utilized while operating within the scope of the present disclosure.

The inner surface 28 of both the interior tile 24 and the exterior tile 26 receives a pair of vertically-oriented stiffener brackets 30. The stiffener brackets 30 provide additional strength and stability for each of the tiles 24, 26, as well as act as the device for securing each of the tiles 24, 26 to the support frame 12. In the embodiment illustrated, each of the stiffener brackets 30 are formed from a metallic material and are adhesively attached to the inner surface 28 of the tiles 24, 26. Although an adhesive attachment is the preferred method of attachment of the stiffener brackets 30, it should be understood that other types of attachment, such as mechanical connectors such as screws, could be utilized while operating within the scope of the present disclosure. Each of the stiffener brackets 30 has a length extending between a lower end 32 and an upper end 34. The length of each of the stiffener brackets 30 is less than the overall length of the tile 24, 26, as can be seen in FIG. 2.

Figure 3:
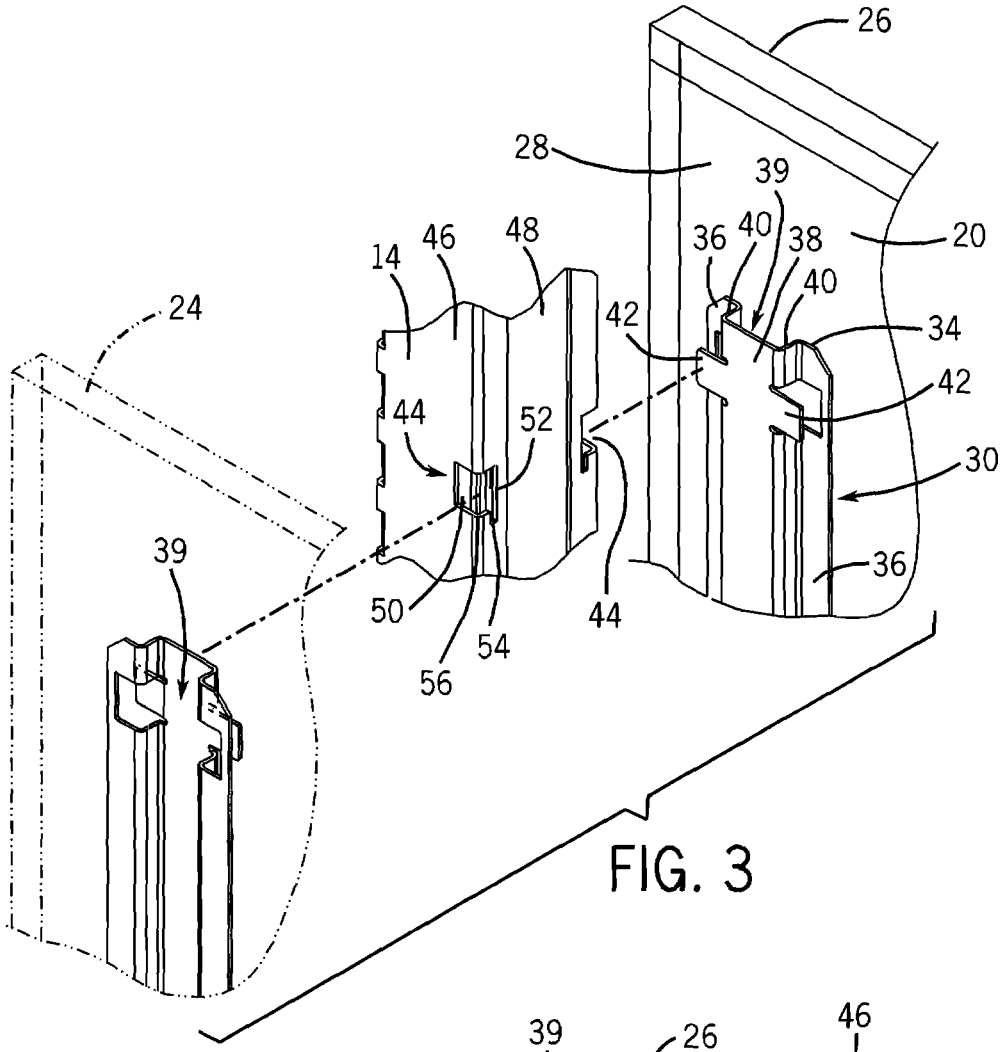
FIG. 3 is a magnified view showing the mounting arrangement used to secure each of the tiles to the support frame.

Referring now to FIG. 3, in the embodiment illustrated, each of the stiffener brackets 30 is formed from a single piece of stamped metallic material. The metallic material used to form each of the stiffener brackets 30 is bent into the general configuration shown in FIG. 3. As illustrated, each of the stiffener brackets 30 includes a pair of generally parallel attachment flanges 36 that are offset from a stiffener bar 38 to define an open channel 39. The stiffener bar 38 is generally parallel to the pair of attachment flanges 36 and is offset by a pair of spaced connecting walls 40. The stiffener brackets 30 are each attached to the inner surface 28 of the tiles 24, 26 by placing an adhesive between the attachment flanges 36 and the inner surface 28.

As illustrated in FIG. 3, each of the stiffener brackets 30 includes a pair of engagement tabs 42 that extend laterally from the stiffener bar 38 near the upper end 34. Although a pair of engagement tabs 42 are illustrated, it should be understood that only a single engagement tab 42 could be utilized. The pair of engagement tabs 42 allow the stiffener brackets 30 to be interchangeably positioned on either side of the tiles 24, 26.

As illustrated in FIG. 3, the engagement tabs 42 extend laterally from the stiffener bar 38 and are formed from a portion of metallic material that would otherwise have formed the connecting walls 40. In the illustrated embodiment, the engagement tabs 42 are stamped out of the same material as the remaining portions of the stiffener brackets 30 such that the engagement tabs 42, the stiffener bar 38 and the attachment flanges 36 are formed from a single piece of metallic material.

Each of the vertical posts 14 includes at least one receiving notch 44 that extends into both the inside sidewall 46 and the front wall 48. In the embodiment illustrated, the front wall 48 includes a receiving notch 44 extending into the front wall 48 from both of the spaced sidewalls 46 such that a tile 24, 26 can be mounted to each side of the vertical posts 14.

Each of the receiving notches 44 includes an access opening 50 formed in the inside sidewall 46 that further extends into the front wall 48 and terminates at a back wall 52. The opening formed in the front wall 48 includes a retaining channel 54 that extends below the lower edge 56 of the access opening 50.

As illustrated in FIG. 2, the lower end 42 of each stiffener bracket 30 can include a similar pair of engagement tabs 42. However, it is contemplated that in alternate embodiments, the stiffener bracket 30 could be formed without the engagement tabs on the lower end 32.

Both the interior tile 24 and the exterior tile 26 are attached between the pair of spaced vertical posts 14 in a similar manner. Initially, the tile 24 is moved toward the vertical post 14 until the engagement tab 42 is brought into alignment with the access opening 50 formed in the sidewall 46. In this manner, the stiffener brackets 30 act to center the tile 24 on the support frame 12.

When the engagement tab 42 is aligned with the access opening, the tile 24 is moved further toward the vertical post 14 until the engagement tab 42 contacts the back wall 52 formed in the front wall 48 of the vertical post 14. When the engagement tab 42 contacts the back wall 52, the tile 24 is lowered such that the engagement tab 42 enters into the retaining channel 54. As the tile 24 is lowered, the lower end 55 of the tile 24 contacts a support ridge 57 of a lower support bracket 59 mounted between the vertical posts 14. The support bracket 59 supports the weight of the tile 24.

When the lower end 55 of the tile 24 is received by the bracket 59, the physical interaction between the engagement tab 42 and the retaining channel 54 prevents the tile from being removed laterally from the vertical posts 14. In an embodiment in which the stiffener brackets 30 include engagement tabs 42 formed near the lower end 32, the engagement tabs 42 formed near the lower end are similarly received within a retaining channel 54. As illustrated in FIG. 2, a series of receiving notches 44 are formed along the height of the vertical posts 14 at equally spaced intervals.

In addition to the stiffener bracket 30 shown in FIG. 3, it should be understood that the stiffener bracket 30 connected near the opposite side of the panel is similarly received within a receiving notch 44 formed in the spaced vertical posts 14. In this manner, the pair of stiffener brackets 30 mount each of the tiles 24, 26 to the spaced vertical posts 14.

Figure 4:
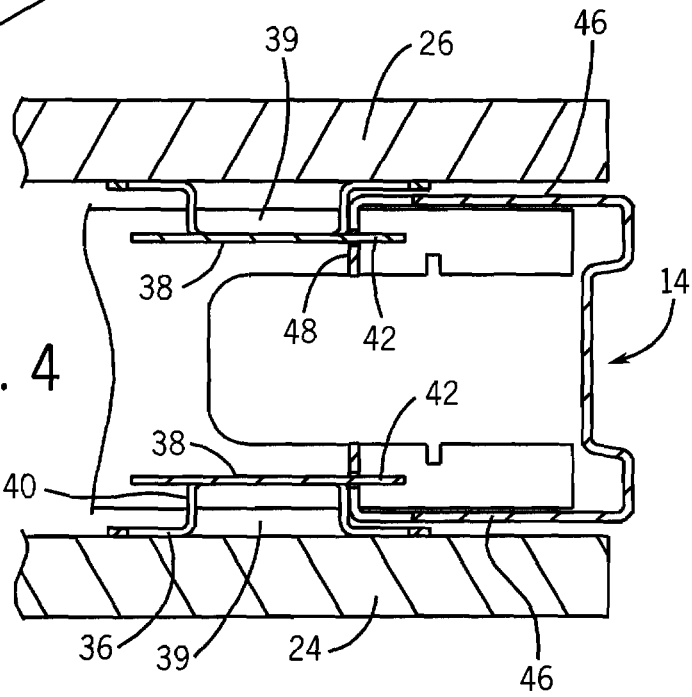
FIG. 4 is a section view taken along line 4-4 of FIG. 1.

As illustrated in FIG. 4, each vertical post 14 supports both the interior tile 24 and the exterior tile 26 through the physical interaction between the engagement tabs 42 and the retaining channel 54 formed in the front wall 48.

Referring back to FIG. 1, the modular panel 10 further includes a decorative top cap 58 that mounts to the support frame and extends over the top end of both the interior tile 24 and the exterior tile 26. The top cap 58 provides for a finished, clean appearance of the modular panel 10. Typically, the top cap 58 is mounted to the modular panel 10 after the interior tile 24 and the exterior tile 26 have been mounted to the support frame.

Figure 5:
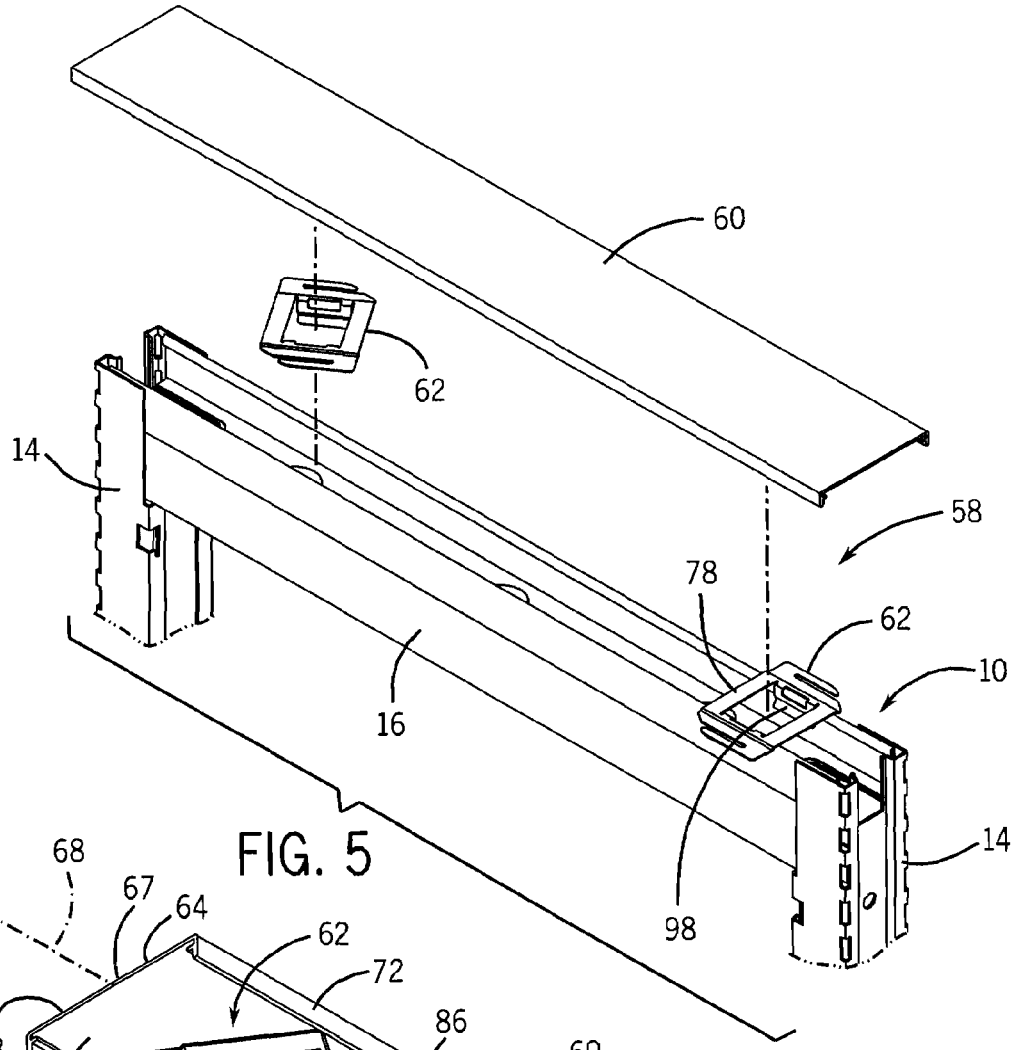
FIG. 5 is an exploded view showing the mounting of the top cap to the panel frame.

As illustrated in FIG. 5, the top cap 58 includes both an elongated body 60 and a pair of attachment clips 62. Although a pair of attachment clips 62 are shown in the embodiment of FIG. 5, it should be understood that either fewer or a greater number of attachment clips 62 could be utilized depending upon the overall length of the elongated body 60. As an example, in an embodiment where the elongated body 60 is shorter than shown, only a single attachment clip 62 may be utilized. Alternatively, when the elongated body 60 extends over a wider modular panel 10, three or more attachment clips 62 may be utilized.

Figure 6:
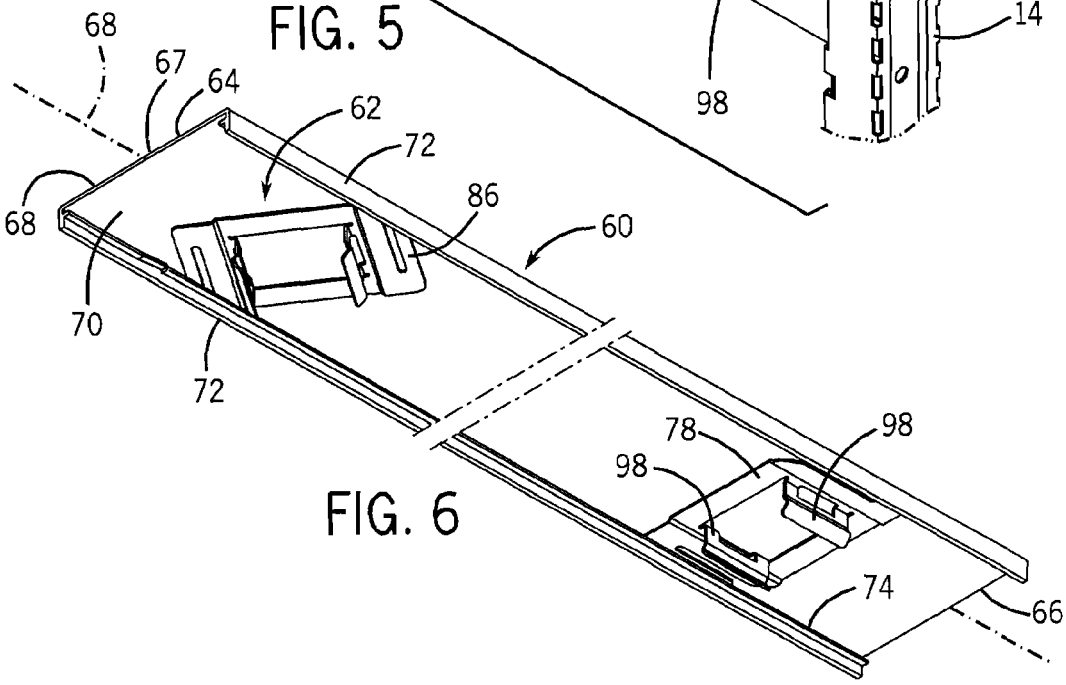
FIG. 6 is a perspective view showing the attachment of a pair of attachment clips to the elongated body of the top cap.

In the embodiment illustrated in FIGS. 5 and 6, the elongated body 60 is formed separate from the attachment clips 62 such that the attachment clips 62 can be installed on the elongated body 60 on site prior to assembly of the modular panel. In this manner, the elongated body 60 and the attachment clips 62 can be formed and shipped separately and assembled on site before installation onto the header 16.

As shown in FIG. 6, the elongated body 60 has an overall length extending along longitudinal axis 68 from a first end 64 to a second end 66. The elongated body 60 includes a top wall 67 defined by an outer surface 68 and an inner surface 70. The top wall 67 extends between a pair of depending sidewalls 72 that generally define the width of the elongated body 60.

Figure 8:
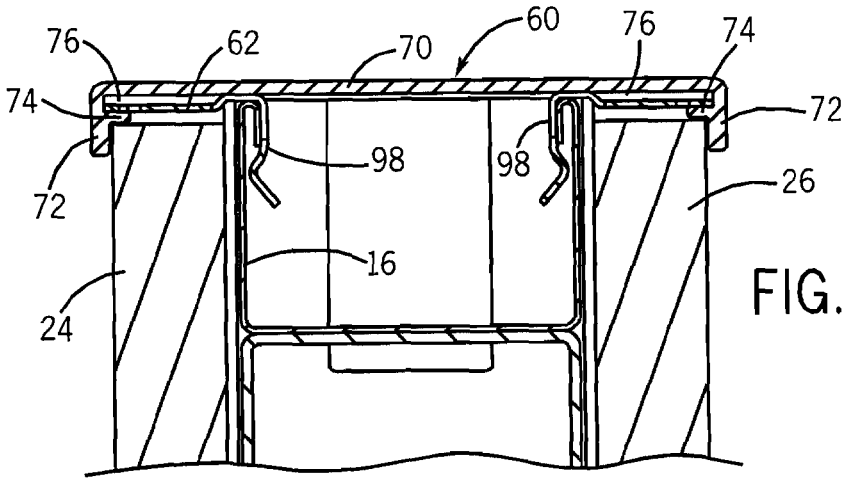
FIG. 8 is a section view taken along line 8-8 of FIG. 1.

As illustrated in FIG. 8, each of the sidewalls 72 includes a web 74 that extends inward from each of the sidewalls 72. The web 74 is spaced from the inner surface 70 to define a receiving cavity 76 that extends along the entire length of the elongated body 60.

Figure 7A:
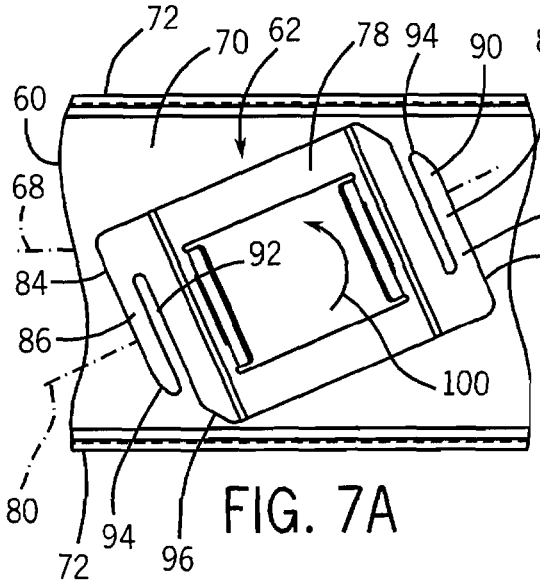
FIGS. 7*a*-7*c* are sequential illustrations showing the attachment of the attachment clip to the elongated body of the top cap.

FIG. 7*a* illustrates the configuration of the attachment clip 62. The attachment clip 62 includes a clip body 78 extending along a longitudinal axis 80. The clip body 78 has a width extending along the axis 80 between a first end 82 and a second end 84. As will be described in greater detail below, the width of each attachment clip 62 is greater than the width of the elongated body 60 between the sidewalls 72.

Each of the attachment clips 62 includes a pair of spring arms 86 having a proximal end 88 and a distal end 90. The distal end 90 is spaced from the clip body 78 by a flexing channel 92 such that the spring arm 86 can flex toward and away from the clip body 78. The distal end 90 of each spring arm 86 includes a tapered end 94. The tapered end 94 is an extension of a tapered edge 96 formed on the clip body 78.

Referring now to FIG. 6, in addition to the spring arms 86, each of the attachment clips 62 includes a pair of spaced attachment prongs 98 that extend perpendicularly from the clip body 78. The attachment prongs 98 provide the means for attaching the attachment clip 62 to the header 16, as is illustrated in FIGS. 5 and 8. As illustrated in FIG. 8, the attachment prongs 98 are spaced such that the prongs 98 flex inward when the attachment clip 62 is pressed downward onto the header 16 until the attachment prongs 98 are in the position shown in FIG. 8. In this manner, the attachment clips 62 can be utilized to secure the top cap 58 to the header 16.

The installation of the attachment clips 62 onto the elongated body 60 will now be described. Initially, each of the attachment clips 62 is moved into the desired location along the length of the elongated body 60, as illustrated in FIG. 6. As illustrated in FIG. 7*a*, once in the desired location, the attachment clip 62 is placed in contact with the inner surface 70. As illustrated in FIG. 7, in this position, the longitudinal axis 80 of the attachment clip 62 is at an angle relative to the longitudinal axis 68 of the elongated body 60.

Once the attachment clip 62 is positioned as shown in FIG. 7*a*, the attachment clip 62 is rotated in the counter-clockwise direction, as shown by arrow 100.

Figure 7B:
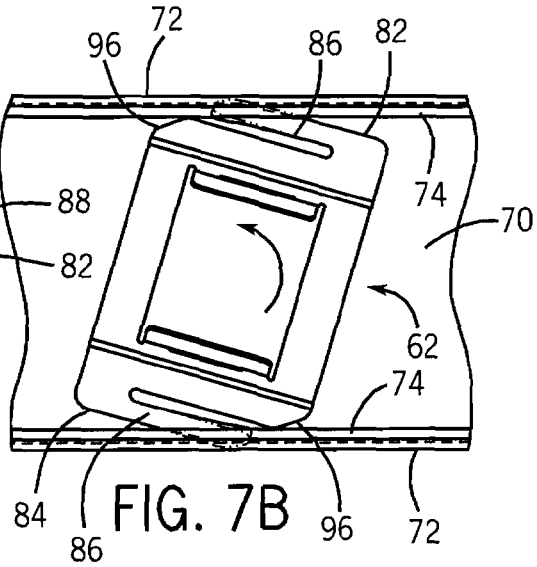

As the attachment clip 62 rotates as shown in FIG. 7*b*, the spring arms 86 each enter into the receiving cavity 76 formed between the extending web 74 and the inner surface 70. As the attachment clip 62 rotates, the tapered end 94 of each spring arm 86 contacts the sidewall 72, causing the spring arm 86 to deflect inwardly. As can be understood in FIG. 7*b*, the tapered edge 96 formed on the clip body 78 further facilitates the rotation shown in FIGS. 7*a* and 7*b*.

Figure 7C:
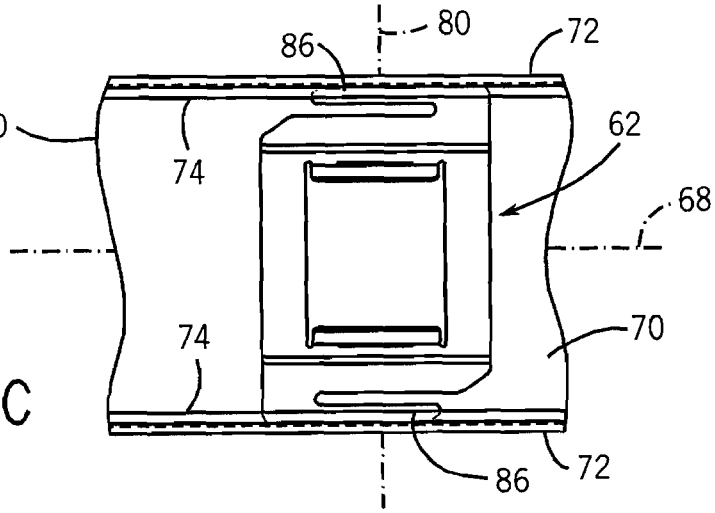

The attachment clip 62 is rotated to the fully installed position shown in FIG. 7*c* in which the longitudinal axis 80 of the attachment clip 62 is perpendicular to the longitudinal axis 68 of the elongated body 60. In this position, the spring arms 86 exert an outward force against the sidewalls 72 to hold the attachment clip 62 in position. Further, the extending web 74 overlies the spring arms 86 to prevent the attachment clips 62 from being pulled away from the inner surface 70.

Once the desired number of attachment clips 62 have been attached to the elongated body 60, the elongated body 60 can be installed on the header 16, as shown in FIG. 8. In this installed position, the sidewalls 72 overly both the interior tile 24 and the exterior tile 26 to provide a visually pleasing appearance for the top end of the wall panel.

As can be understood in the embodiment of the top cap 58 illustrated in FIGS. 5 and 6, the elongated body 60 can be formed of any desired length depending upon the size of the panel being constructed. Further, the elongated body can be cut to the desired length prior to attachment, since the attachment clips are not fixed to the body 60. Once the elongated body 60 is formed, the attachment clips 68 can be installed as described. Typically, the top cap 58 is pre-assembled with the attachment clips 68 in the desired position so that the wall panel system can be assembled at the desired location.

We claim:

1. A top cap for use with a modular panel having a frame and a pair of tiles supported by the frame, the top cap comprising:

an elongated body including an outer surface, an inner surface and a pair of spaced sidewalls, wherein the elongated body includes a pair of receiving cavities each at least partially defined by the inner surface and one of the sidewalls, wherein the receiving cavities each extend along the length of the elongated body; and at least one attachment clip removably rotatably attached to the elongated body at a user selectable location along a length of the elongated body, wherein the attachment clip includes a main body and a pair of spring arms connected to the main body, wherein the width of the attachment clip between the pair of spring arms is greater than the width of the elongated body between the spaced sidewalls, wherein the spring arms are received in the receiving cavities to secure the attachment clip to the elongated body.

2. The top cap of claim 1 wherein the attachment clip includes a pair of prongs extending from the main body, wherein the prongs are received in the frame to secure the top cap to the frame.

3. The top cap of claim 1 wherein the spring arms on the attachment clip include a tapered distal end.

4. The top cap of claim 3 wherein a proximal end of each of the spring arms is securely attached to the main body of the attachment clip.

5. A modular panel system comprising:

a support frame having a pair of vertical posts and a header extending between the vertical posts, wherein each of the vertical posts includes at least one receiving notch;

at least one tile having an outer face surface and an inner face surface;

a pair of tile stiffeners attached to the inner surface of the tile, each tile stiffener having an engagement tab extending from the tile stiffener, wherein the engagement tabs are received in the receiving notches to retain the tile on the pair of vertical posts of the support frame; and a top cap mounted to the header, the top cap comprising an elongated body including an outer surface, an inner surface and a pair of spaced sidewalls, wherein the elongated body includes a pair of spaced receiving cavities each defined by the inner surface and one of the sidewalls and extending along the length of the elongated body and at least one attachment clip removably rotatably attached to the elongated body at a user selected location along a length of the elongated body, wherein the attachment clip includes a main body and a pair of spring arms connected to the main body, wherein the width of the attachment clip between the pair of spring arms is greater than the width of the elongated body between the spaced sidewalls, wherein the spring arms are received in the receiving cavities to secure the attachment clip to the elongated body, wherein the attachment clip secures the top cap to the header.

6. The top cap of claim 5 wherein the attachment clip includes a pair of prongs extending from the main body, wherein the prongs are received in the header to secure the top cap to the header.

7. The modular panel system of claim 5 wherein each of the tile stiffeners are attached to the inner surface of the tile by an adhesive.

8. A method of forming a top cap for use with a modular panel having a frame and a pair of tiles supported by the frame, the method comprising the steps of:

providing an elongated body having an outer surface, an inner surface, a pair of spaced sidewalls and a pair of receiving cavities extending parallel to a longitudinal axis of the elongated body;

providing at least one attachment clip having a pair of spring arms and a width extending along a longitudinal axis of the attachment clip;

positioning the attachment clip at a selected location along the length of the elongated body, wherein the longitudinal axis of the attachment clip is initially positioned at an angle relative to the longitudinal axis of the elongated body; and rotating the attachment clip until the longitudinal axis of the attachment clip is perpendicular to the longitudinal axis of the elongated body to secure the attachment clip to the elongated body at the selected location, wherein the spring arms deflect upon rotation of the attachment clip such that the spring arms are received in the pair of receiving cavities of the elongated body and the spring arms engage the sidewalls of the elongated body to hold the attachment clip on the elongated body.

9. The method of claim 8 wherein the spring arms each have a tapered distal end such that the attachment clip can be rotated relative to the elongated body in only one direction.

10. The method of claim 9 wherein the distal end of each spring arm is received in one of the receiving cavities prior to rotation of the attachment clip.

11. The top cap of claim 1 wherein the at least one attachment clip is rotatably attached to the elongated body prior to attachment of the top cap to the frame.

* * * * *